US006983007B2

(12) United States Patent
Barto et al.

(10) Patent No.: US 6,983,007 B2
(45) Date of Patent: Jan. 3, 2006

(54) METHOD OF MANUFACTURING ELECTRODES AND A REUSABLE HEADER FOR USE THEREWITH

(75) Inventors: Louis J. Barto, Youngstown, OH (US); Frank P. Spadafora, Niles, OH (US)

(73) Assignee: RMI Titanium Company, Niles, OH (US)

( * ) Notice: Subject to any disclaimer, the term of this patent is extended or adjusted under 35 U.S.C. 154(b) by 52 days.

(21) Appl. No.: 10/718,045

(22) Filed: Nov. 20, 2003

(65) Prior Publication Data

US 2005/0111517 A1 May 26, 2005

(51) Int. Cl.
*H05H 7/102* (2006.01)

(52) U.S. Cl. ..... 373/69; 373/67; 373/92

(58) Field of Classification Search ..... 373/67–69, 373/88–92, 94, 98–100; 164/508–509, 514–515; 75/10.23, 10.24; 266/201
See application file for complete search history.

(56) References Cited

U.S. PATENT DOCUMENTS 2,955,333 A * 10/1960 Busby et al. ..... 164/514
3,391,239 A * 7/1968 Inouye ..... 373/69
5,373,529 A * 12/1994 Zanner et al. ..... 373/68

* cited by examiner

*Primary Examiner*—Tu Hoang
(74) *Attorney, Agent, or Firm*—Sand & Sebolt

(57) ABSTRACT

A method of manufacturing titanium electrodes in a vacuum arc remelting furnace as well as a reusable header for use in the remelting process is disclosed. An electrode may be attached to the reusable header and remelted in the furnace a number of times until a final ingot of the desired metallurgical quality is produced. The header and electrode are provided with a complimentarily shaped interlocking recess and projection to secure them together. The electrode may alternatively be integrally formed with a starter stub that includes a recess or projection that interlocks with a complimentarily shaped projection or recess on the header. At least a section of the header is made of the same metal as the electrode to be melted to reduce contamination of the ingot being formed in the furnace. Alternatively the starter stub is made from the same metal as the electrode.

47 Claims, 16 Drawing Sheets

METHOD OF MANUFACTURING ELECTRODES AND A REUSABLE HEADER FOR USE THEREWITH

BACKGROUND OF THE INVENTION

1. Technical Field

This invention generally relates to a method of manufacturing electrodes and more particularly to a method of manufacturing electrodes in a vacuum arc remelting furnace. Specifically, the invention relates to a method of manufacturing titanium electrodes, which method includes the use of a reusable header for supporting the electrodes to be melted within the furnace.

2. Background Information

There is a need in industry for high metallurgical quality metals such as titanium, titanium alloys and superalloys. These products are utilized in the production of turbines for aircraft and ships and in various other industrial applications. Often, high quality titanium metal and its alloys are produced by a process known as vacuum arc remelting. In this process, an electrode, made of titanium material, is melted by a direct current arc into a water-cooled crucible or hearth under a vacuum. The electrode may be formed from scrap materials, titanium sponge compacts and bulk scrap pieces that are melted together by electron beam or plasma arc melting or are conventionally welded together. The electrode is then welded to a header or stinger that is connected to a ram. The welding of the electrode to the header is both time consuming and labor intensive and therefore adds to the production costs for the process. Once the electrode is welded to the header, a ram lowers the electrode into the crucible or hearth where it is melted by a direct current arc struck between the surface of the electrode and the crucible. Molten droplets of metal fall from the electrode onto the bottom plate of the crucible thereby forming a molten ingot pool. As the arc is struck between the electrode and the ingot pool, the depth of the ingot pool increases. The crucible or hearth is water-cooled and consequently the molten ingot pool gradually cools down and solidifies into an ingot. As the depth of the solidifying ingot increases, the ingot may either be slowly withdrawn from the crucible or will tend to gradually fill up the crucible. The process continues until the electrode is substantially consumed and an ingot of higher metallurgical quality has been formed. The newly formed ingot may be as long as 300 inches. The ingot is allowed removed from the crucible and is allowed to cool over a number of days. If a higher grade metal is required, the newly formed ingot is again welded to a header so that it may be used as a second electrode. The need to wait until the ingot has cooled and then to weld the second electrode to the header again adds to the production costs. The second electrode is remelted using the same process and a second ingot of still greater quality is produced. This cycle of forming an ingot, welding the ingot to the header so that it may be used as an electrode, and melting the electrode to form a new ingot of improved metallurgical quality is repeated until the desired metallurgical qualities are produced in the final ingot.

During production, the forming ingot may be contaminated by accidental arcing of the header. As the electrode is consumed, it is reduced in length. If, however, the length of the titanium electrode is reduced too much, accidental arcing of the header may cause some of the material from the header to melt and drop into the ingot pool. This tends to contaminate the titanium metal in the ingot pool and additionally causes damage to the header. In order to overcome this problem, it has been customary to stop the direct arcing of the electrode some distance from the weld between the header and the electrode. While this tends to resolve the problem of accidental contamination of the ingot and damaging the header, it also raises the cost of production. If, for example, the initial electrode is 300 inches in length and the direct arcing of the electrode must be ended around 3–5 inches from the weld of the electrode to the header, that 3–5 inches of electrode are waste material. The 3–5 inches of titanium may weigh around 500 lbs and the scrapping of this quantity of material from each phase of the melting process adds considerably to the costs of production. Furthermore, because accidental arcing and subsequent damage to the header may occur, there may be a need for the header to be periodically rebuilt or repaired. This again increases the cost of production.

There is therefore a need in the industry for a method of manufacturing electrodes in a more efficient and less expensive manner.

BRIEF SUMMARY OF THE INVENTION

An objective of the invention is to provide a reusable header for manufacturing electrodes and more specifically to provide a header that is easily attached and detached to an electrode.

A second objective of the invention is to provide a reusable header that will tend to reduce foreign material contamination of the electrode if the header is accidentally arced and partially melted during manufacture.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
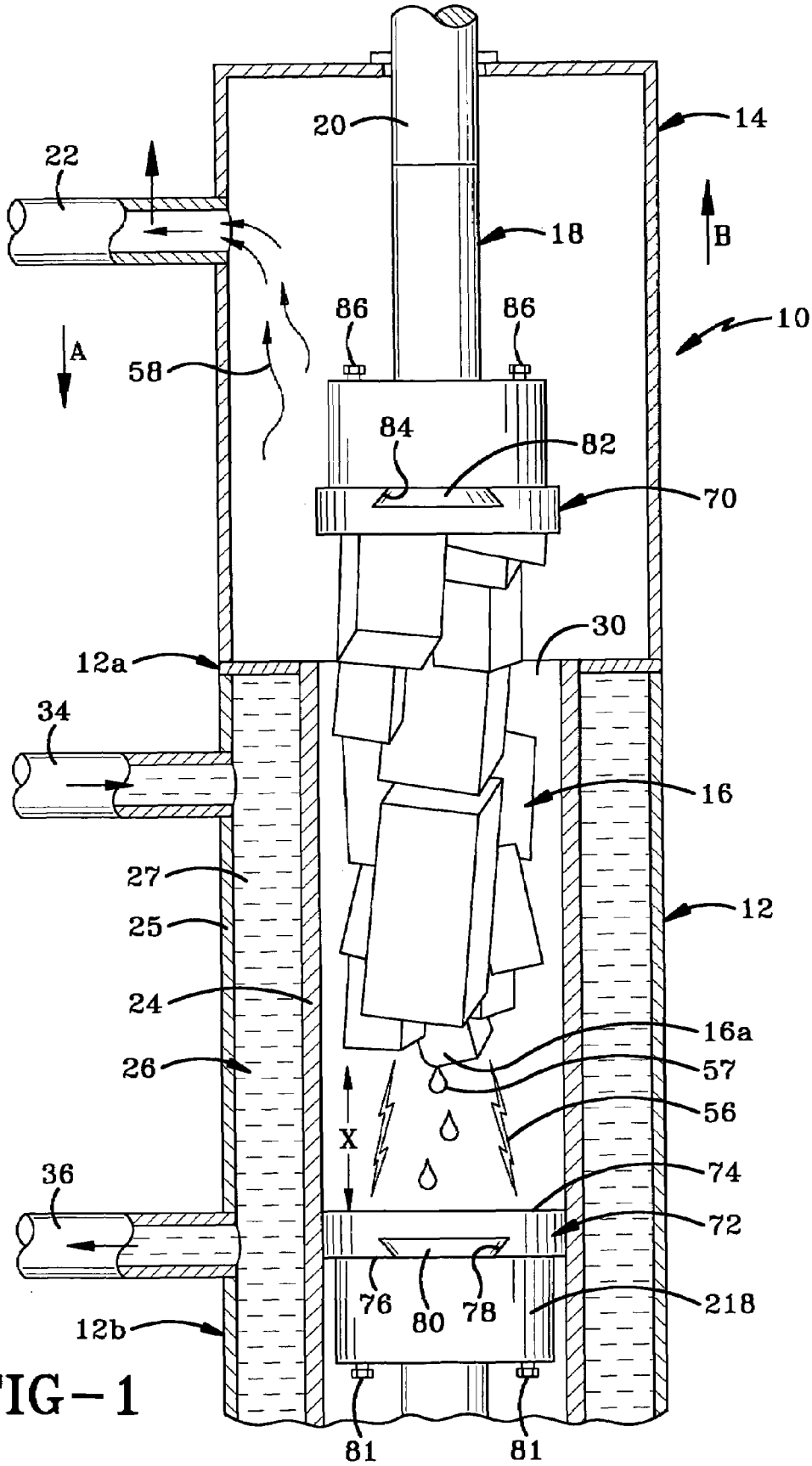
FIG. 1 is a partial cross-sectional front view of a first embodiment of a furnace with a reusable header in accordance with the present invention.
Figure 1A:
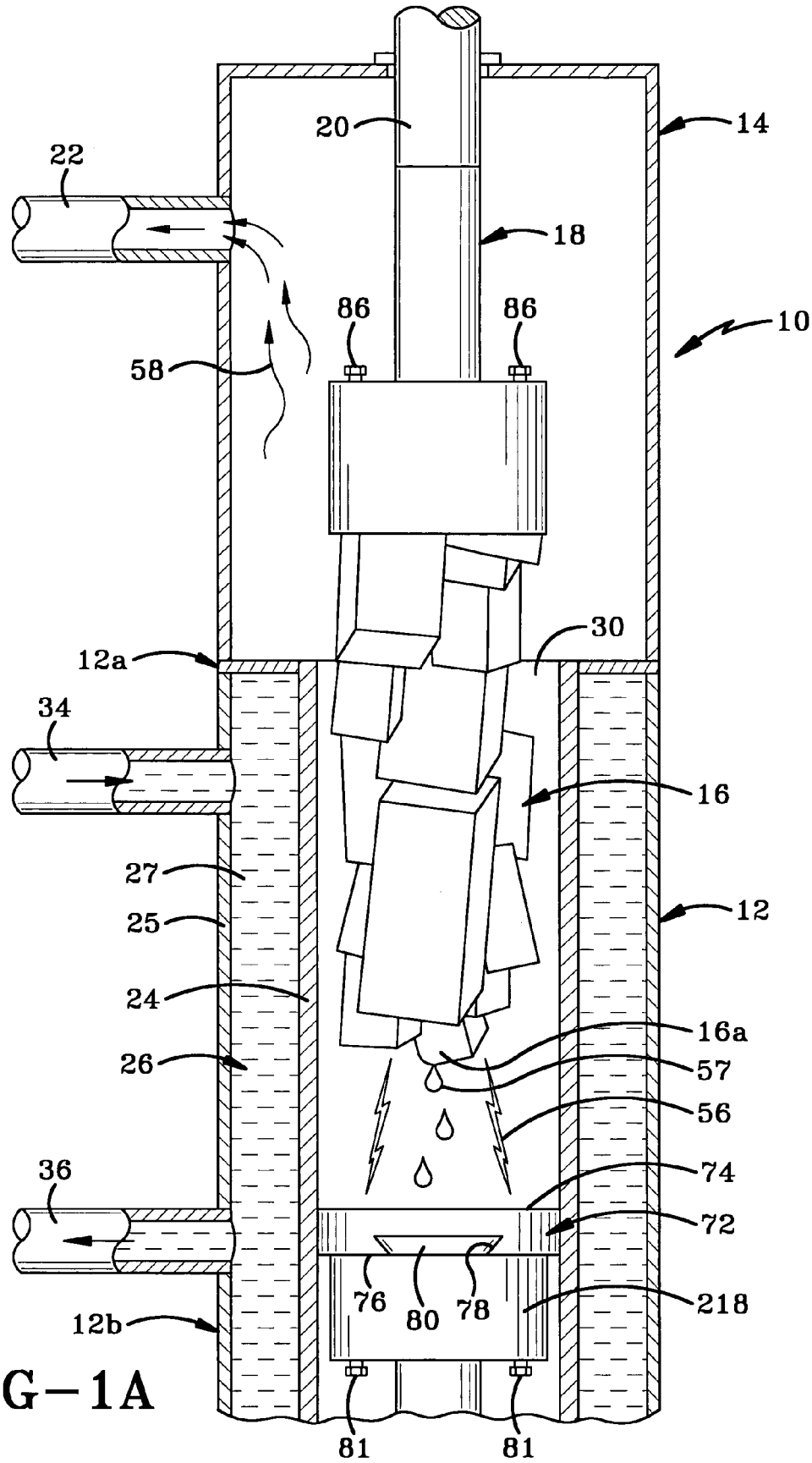
FIG. 1A is a partial cross-sectional front view of a furnace with a reusable header in which the electrode is welded directly onto the header.
Figure 1B:
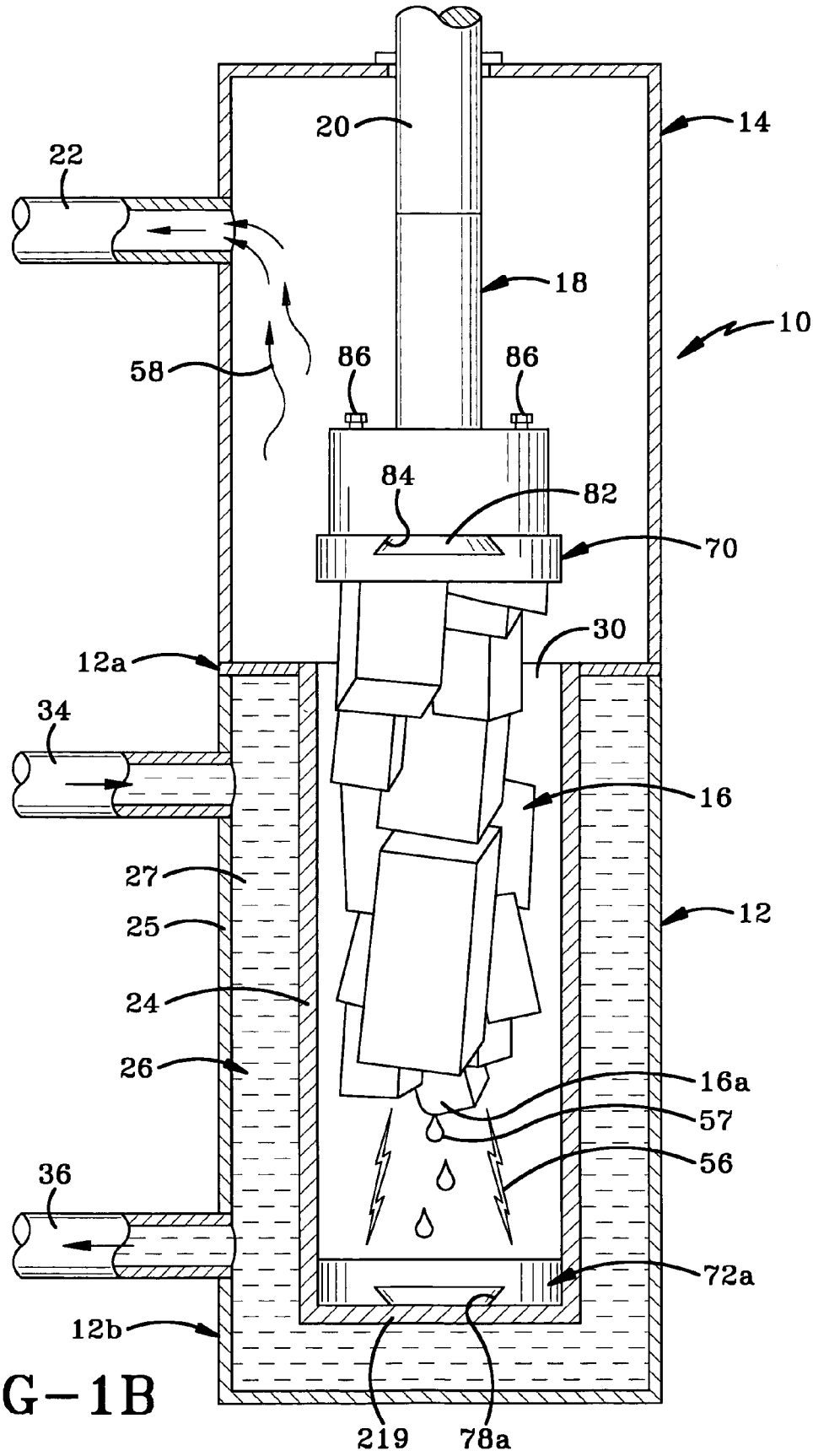
FIG. 1B is a partial cross-section front view of a furnace with a reusable header showing the crucible having a solid bottom plate onto which a starter stub is placed.

Referring to FIGS. 1–10, there is shown a vacuum arc remelting furnace, generally referred to by the number 10, having a crucible 12 and a housing 14. A reusable header 18 in accordance with the present invention is preferably detachably connected to a ram 20. Header 18 may engage a plate or starter stub 70 that supports an electrode 16 as is shown in FIG. 1. Alternatively, electrode 16 may be directly welded onto header 18 as is shown in FIG. 1A. Header 18 may be manufactured from a variety of materials including steel or titanium without departing from the spirit of the invention. Ram 20 moves header 18, and therefore starter stub 70, if provided, and electrode 16, toward or away from a mold 30 in crucible 12. Electrode 16 is heated by a direct current arc 56 to a temperature sufficient to melt electrode 16. The molten metal 57 from electrode 16 falls onto a second starter stub 72 disposed within crucible 12. The molten metal accumulates on second starter stub 72 and solidifies to form an ingot 32 that becomes integrally bonded with second starter stub 72. As is shown in FIG. 1, ingot 32 and second starter stub 72 may be withdrawn from crucible 12 by lowering a ram 218 from the lower end 12*b* of crucible 12 and ingot 32 may then be used as an electrode 32A (FIG. 9) in further processing of the metal or in other industrial applications. Alternatively, as is shown in FIG. 1B, the molten metal may accumulate on a second starter stub 72*a* that is placed on the bottom plate 219 of crucible 12. Ingot 32, once formed on second starter stub 72*a*, may then be withdrawn from the upper end 12*a* of crucible 12 by a crane. Second starter stub 72*a*, having recess 78*a* may then be engaged with a projection 80 on header 218 and ingot 32 may be used as an electrode 32A. If ingot 32 is going to be used as electrode 32A, the manufacturer may not need to allow ingot 32 to cool down completely before it can be attached to a header 18, 218. This is because the attachment of ingot 32 to header 18/218 is made via second starter stub 72. This possible reduction in cooling time may reduce both production time and the amount of energy needed to remelt electrode 32A.

Furnace 10 includes a housing 14 disposed over crucible 12. Housing 14 includes an outlet 22 that is connected to a vacuum system (not shown). The vacuum system evacuates air 58 from within housing 14, thereby creating a vacuum within housing 14. Crucible 12 may be generally cylindrical in shape, having an inner lining 24 and a coaxial outer wall 25 which together form a compartment 26. Compartment 26 of crucible 12 includes a water inlet 34 and a water outlet 36. Water 27 entering compartment 26 through inlet 34 is circulated through compartment 26 and exits through outlet 36. The circulating water 27 cools the molten metal within crucible 12 and this accelerates solidification of the molten metal into an ingot 32.

Figure 17:
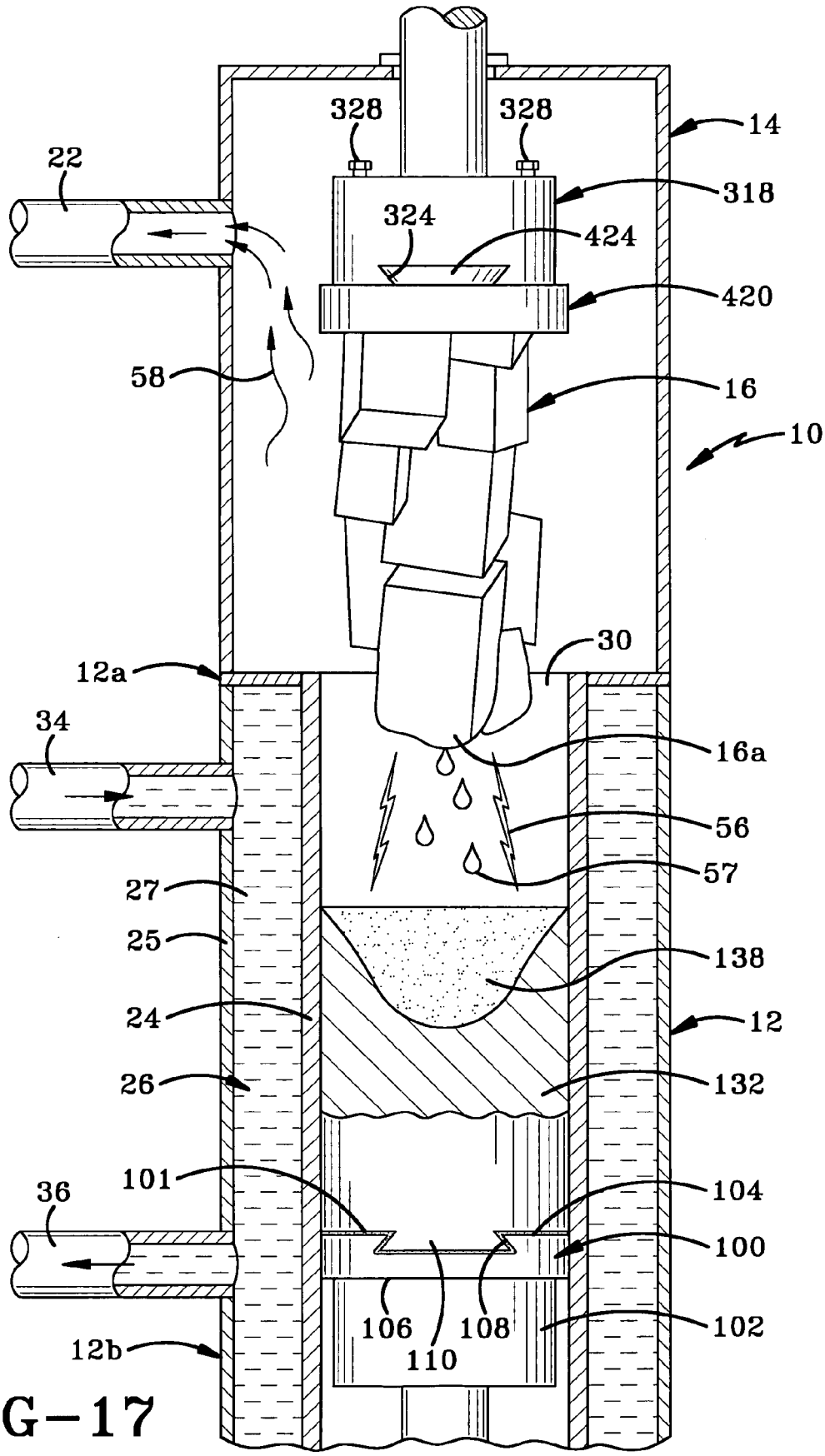
FIG. 17 is a partial cross-sectional front view of the second embodiment of the reusable header, wherein an ingot is being molded in a form disposed in the crucible.
Figure 18:
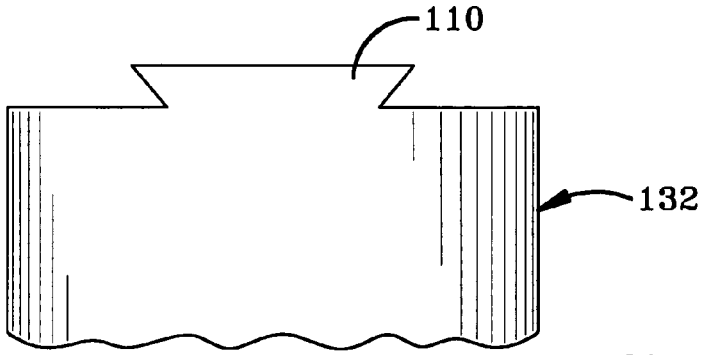
FIG. 18 is a partial front view an electrode that has been molded in the form, the electrode being shaped to engage the reusable header of FIG. 11.
Figure 19:
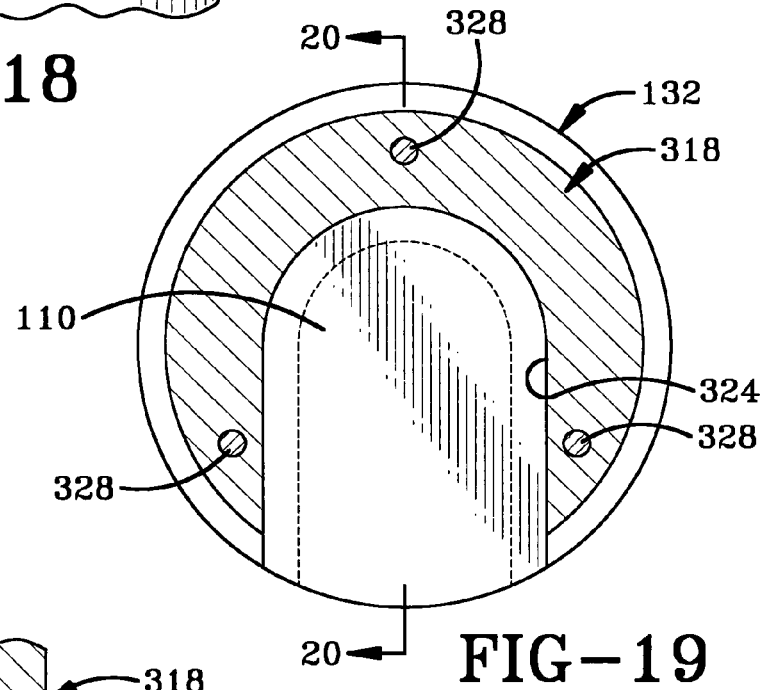
FIG. 19 is a cross-sectional bottom view of the electrode engaged in the header.
Figure 20:
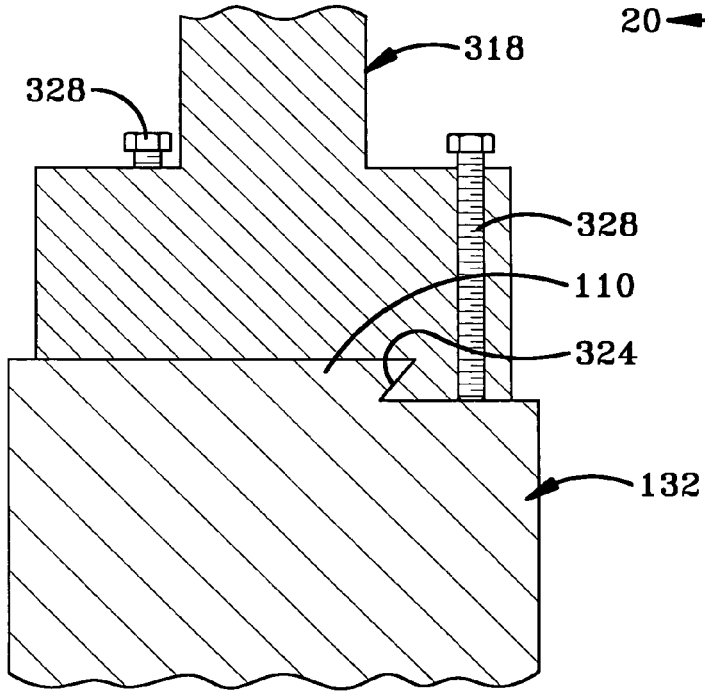
FIG. 20 is a partial cross-sectional side view through line 19—19 of FIG. 19 showing the electrode engaged in the header.
Figure 21:
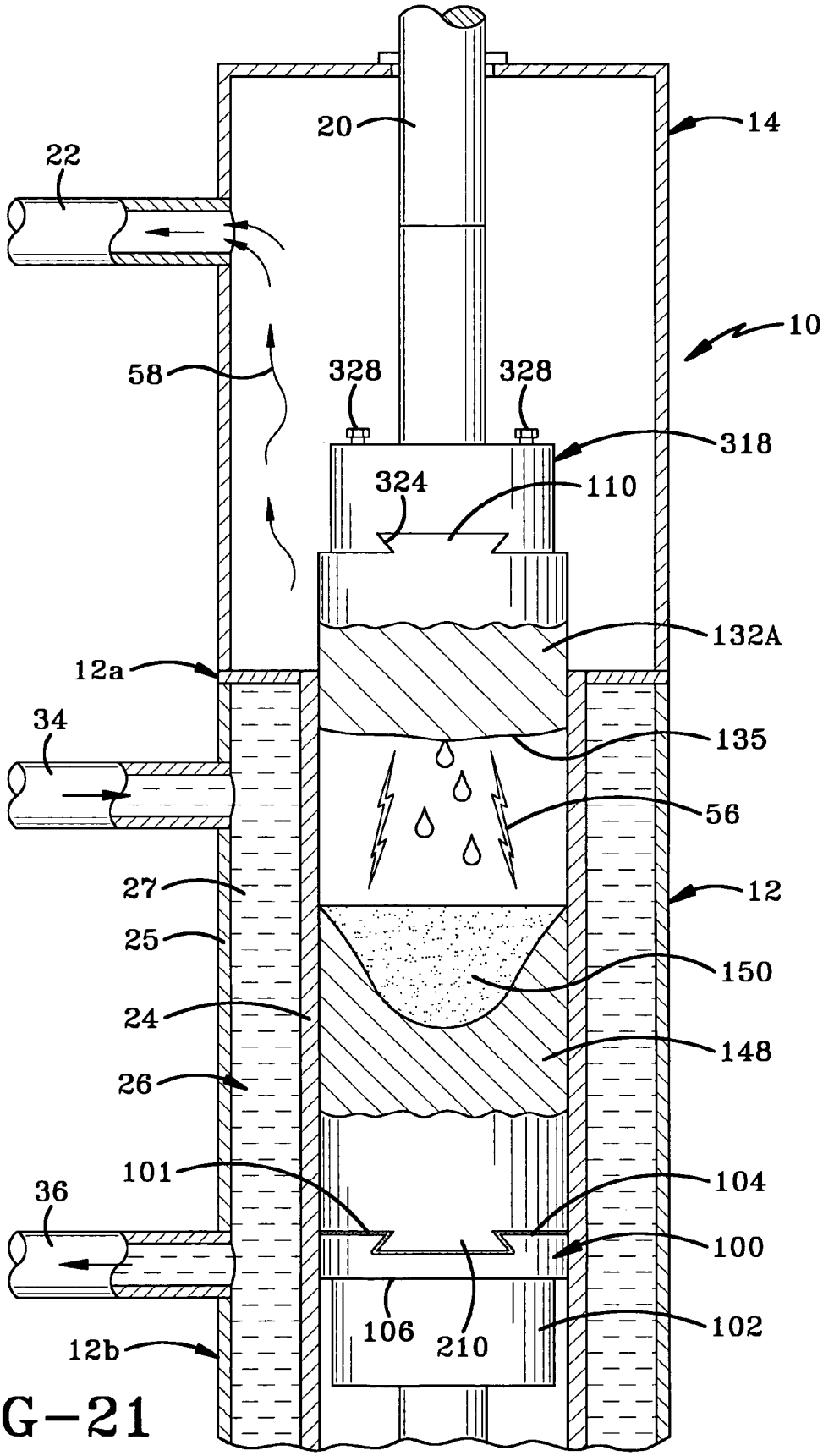
FIG. 21 is a partial cross-sectional front view of the furnace showing a second melt and the molding of a more refined ingot in the form.
Figure 22:
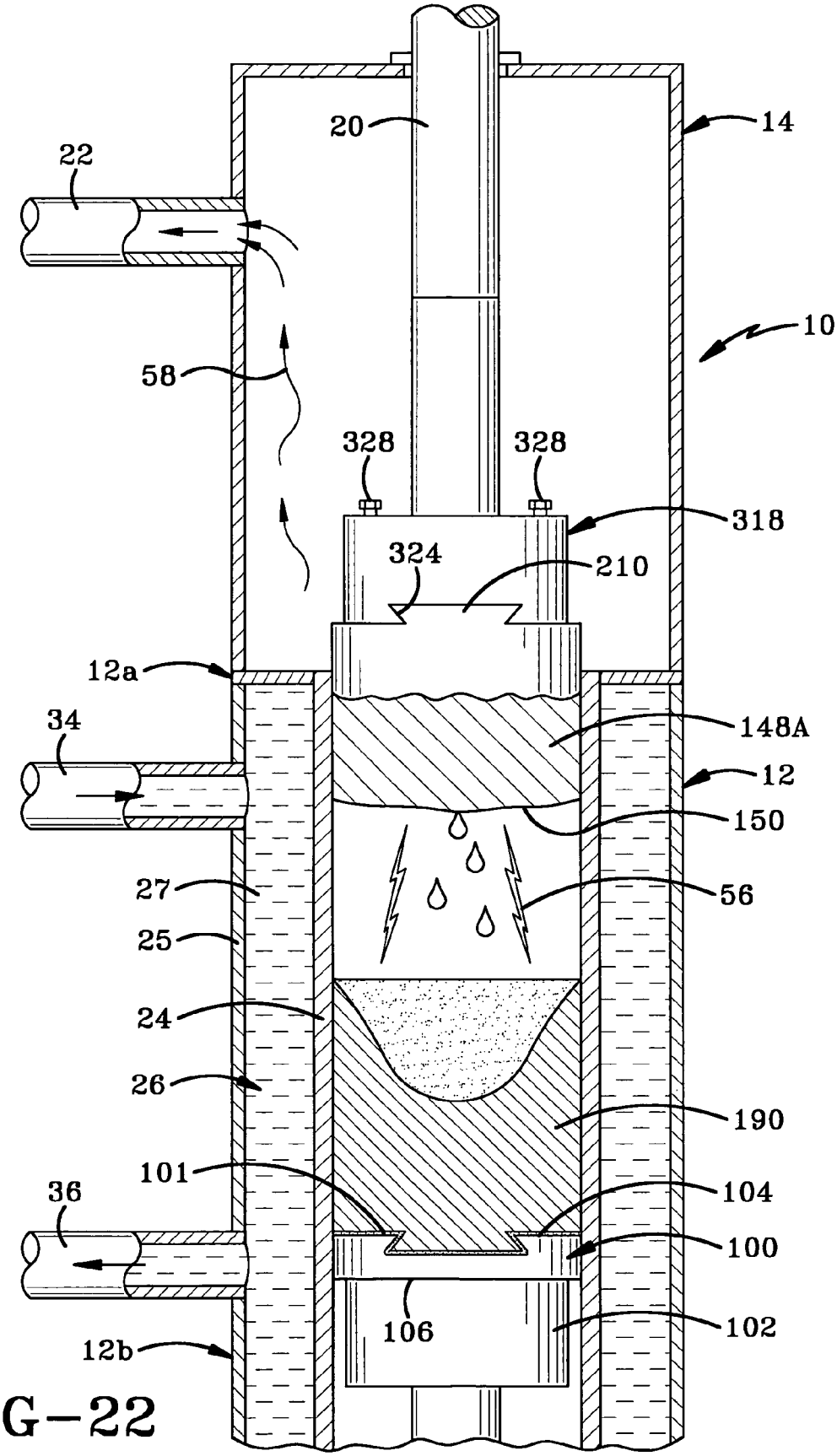
FIG. 22 is a partial cross-sectional front view of the furnace showing a final ingot of the desired metallurgical quality being formed.

Inner lining 24 is engaged by a plate proximate the lower end 12*b* of crucible 12. The plate effectively seals the lower end 12*b* of crucible 12 and thereby forms a chamber or mold 30 in which an ingot 32 may be molded. This plate may be a starter stub as in 70 or 72 as shown in FIG. 1 (or may be a form 100 as shown in FIG. 17).

The following description will refer to second starter stub 72 only for the sake of clarity, but the description applies to other stubs which may be used in furnace 10, such as starter stub 70. Starter stub 72 is manufactured from substantially the same metal as is to be melted within furnace 10. So, for example, if the metal to be melted in furnace 10 is a titanium alloy, then starter stub 72 will be manufactured from the same titanium alloy. If a variety of metals are to be melted in furnace 10, then a plurality of starter stubs may be provided, each starter stub being manufactured from a different metal. Additionally, if the metal to be melted in the furnace will be remelted several times so that the metallurgical properties of the metal will be substantially different from the beginning of the process to the end of the process, then a plurality of starter stubs may be provided, each starter stub having different metallurgical properties and being utilized for the different steps in the remelting process. Furthermore, if it is desired to be able to easily visually distinguish the metallurgical qualities of a particular electrode from others produced in a series of melts, a plurality of starter stubs, of different thicknesses or colors or having differently shaped connections for engaging various headers, may be provided for attachment to electrodes having different metallurgical properties.

Starter stub 72 preferably has a substantially flat upper surface 74 and a shaped lower surface 76. Lower surface 76 includes a recess 78 that is adapted to engage a complimentarily shaped projection 80 on header 218 or projection 82 on header 18. Starter stub 72 may be supported proximate the lower end 12*b* of crucible 12 by second reusable header 218, or it may be supported by a second ram (not shown) or it may rest against an interior bottom wall (not shown) of crucible 12. Starter stub 72 is adapted to engage either reusable header 18 or second reusable header 218. Both reusable header 18 and second reusable header 218 are preferably manufactured from substantially the same metal that is to be melted in the vacuum arc furnace. So, for example, if the metal to be refined in the furnace is titanium, then header 18 and header 218 are preferably manufactured from titanium. A number of different reusable headers may be provided if furnace 10 is to be used to melt a variety of different metals or if different metallurgical quality metals need to be separated for easy identification. For example, if one type of metal, titanium for example, is to be melted several times in the furnace to obtain a final ingot of substantially different metallurgical quality from the initial material, then a number of reusable headers having differing metallurgical properties may be provided for use with furnace 10. This decreases the possibility of contamination of the ingot 32 with a foreign metal or with a metal of substantially different metallurgical quality. However, a conventional steel header may also be utilized with starter stub 72 without departing from the spirit of the present invention. In this instance starter stub 72 may be considered to be a detachable section of the header where the header is made of steel and the starter stub 72 is made from substantially the same metal to be melted in furnace 10.

The following description will reference header 218 only for the sake of clarity, but it applies equally to header 18. Header 218 includes a base 218*a* that is preferably integrally formed with a coaxial shaft 218*b*. Shaft 218*b* is substantially cylindrical in shape and is adapted to receive ram 20 (FIG. 4) or another ram (not shown) either therein or thereover. Shaft 218*b* is connected to ram 20 by way of rivets, screws, interlocking components or any other suitable mechanism known in the art. Base 218*a* is provided with a dovetail-shaped projection 80 that is adapted to be received within the complimentarily shaped and configured dovetailed-shaped recess 78 in starter stub 72. While projection 80 and recess 78 are shown as being a traditional dovetail, it will be understood by those skilled in the art that any other suitable complimentarily shaped and configured projection and recess combination may be utilized to link the header 218 to starter stub 72. Screws extend through apertures 79 to force the walls of projection 80 into abutting engagement with the walls of recess 76.

Figure 2:
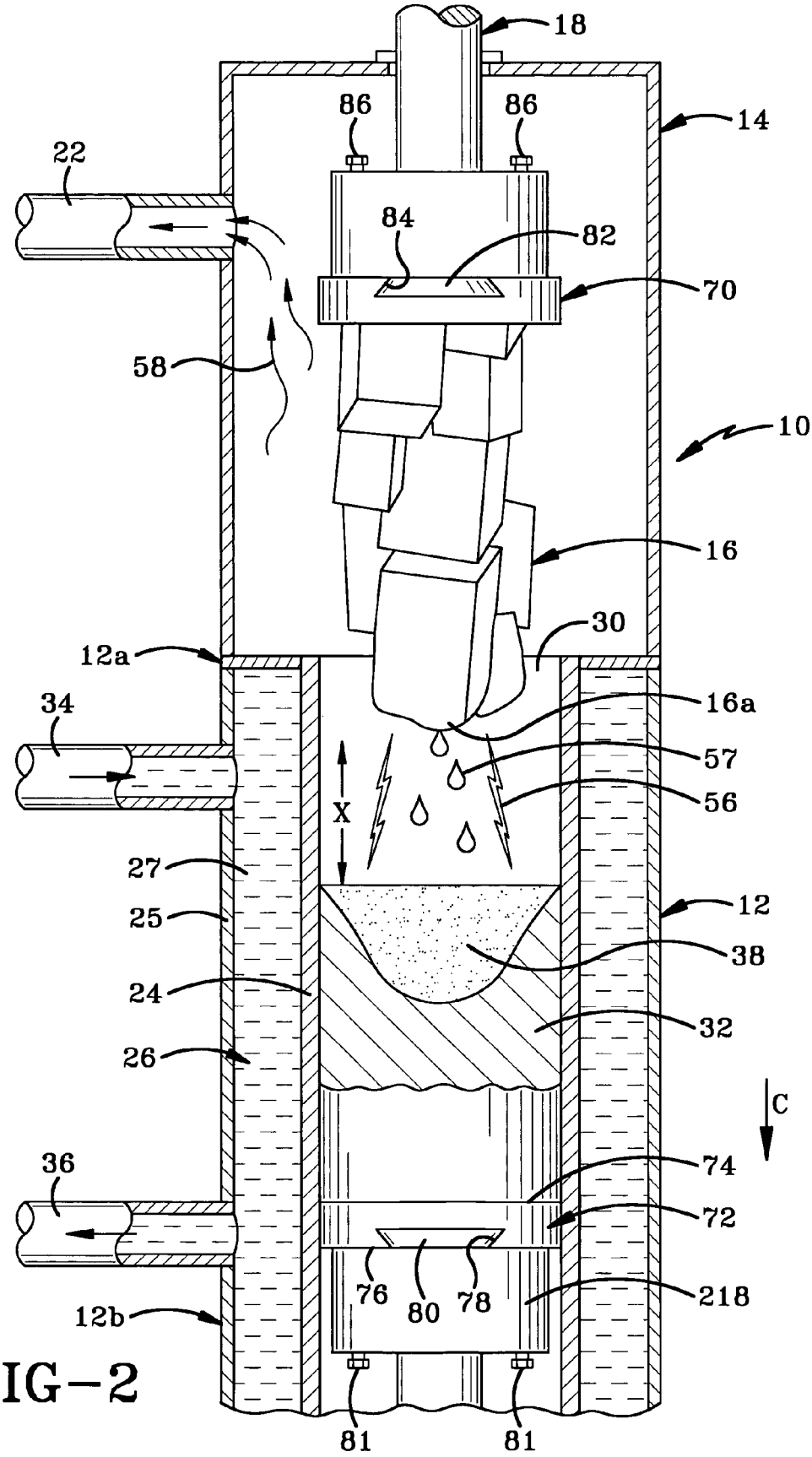
FIG. 2 is a partial cross-sectional front view of the furnace showing molten metal building up within the crucible.
Figure 3:
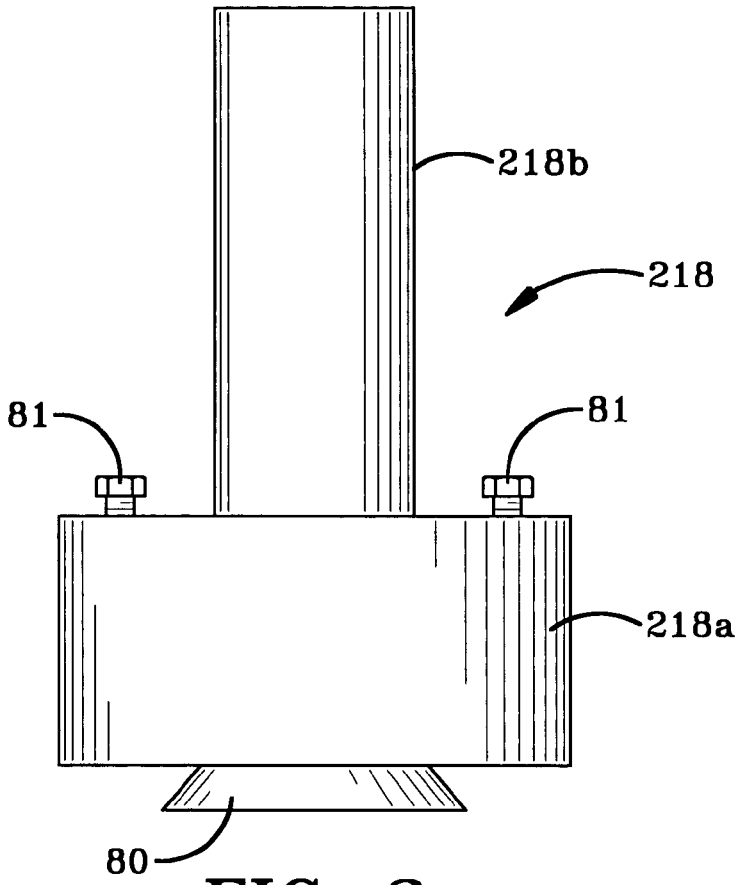
FIG. 3 is front view of the reusable header in accordance with the present invention.
Figure 4:
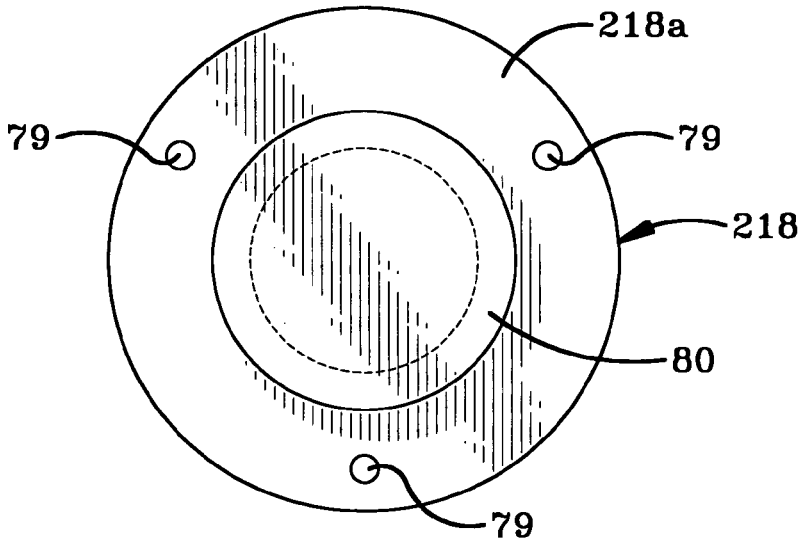
FIG. 4 is a bottom view of the reusable header of FIG. 3.
Figure 5:
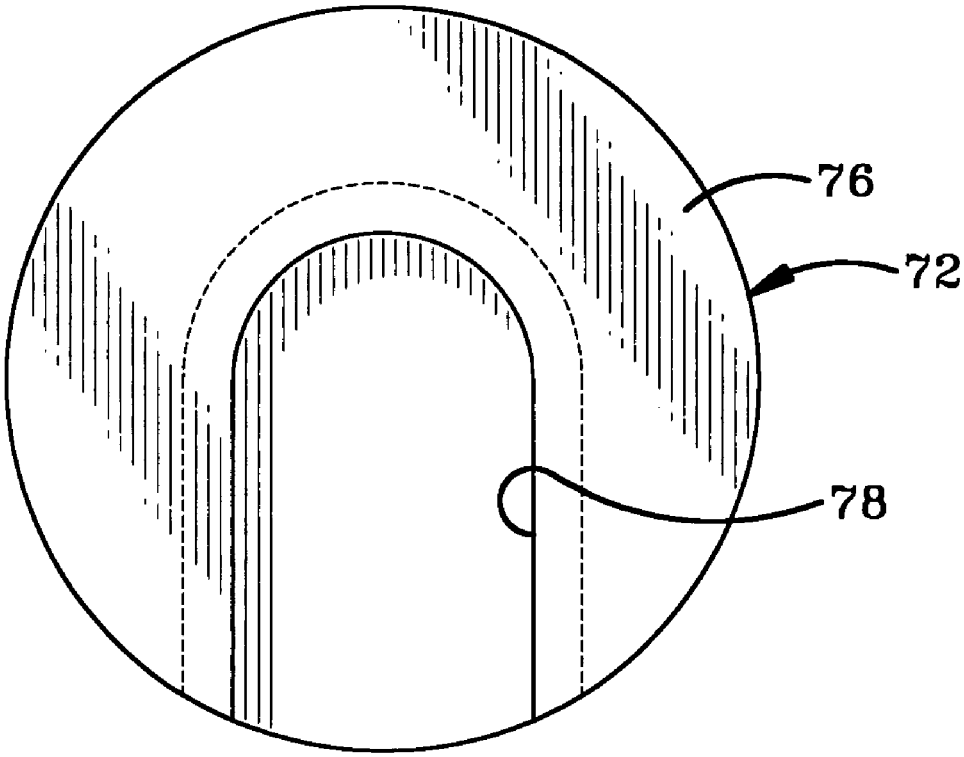
FIG. 5 is a top view of the starter stub for engagement with the reusable header.
Figure 6:
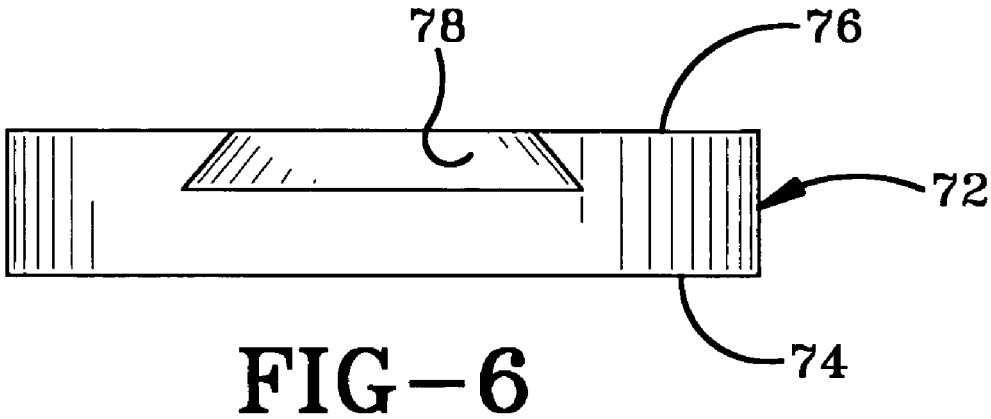
FIG. 6 is a front view of the starter stub that engages the reusable header.
Figure 7:
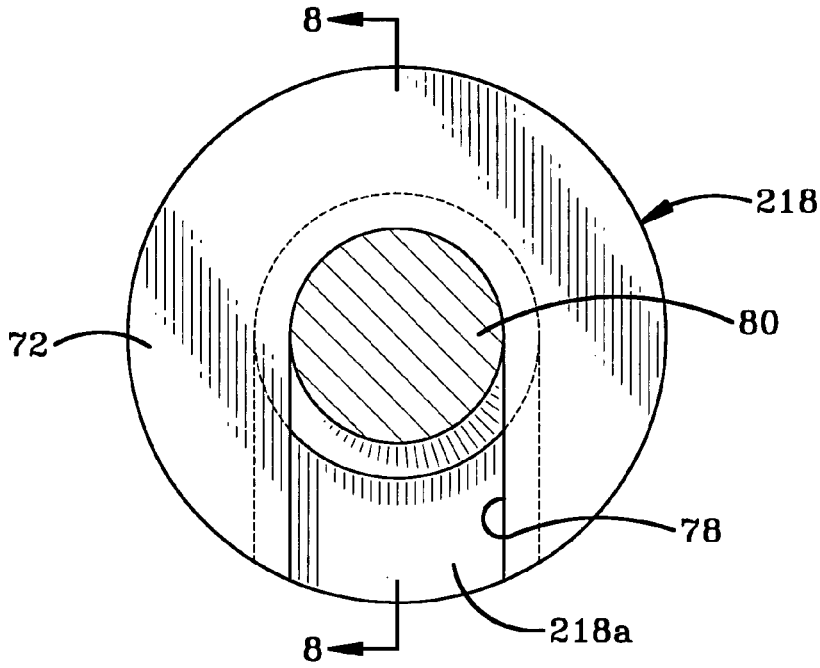
FIG. 7 is a partial cross-sectional bottom view showing the starter stub engaged with the header.
Figure 8:
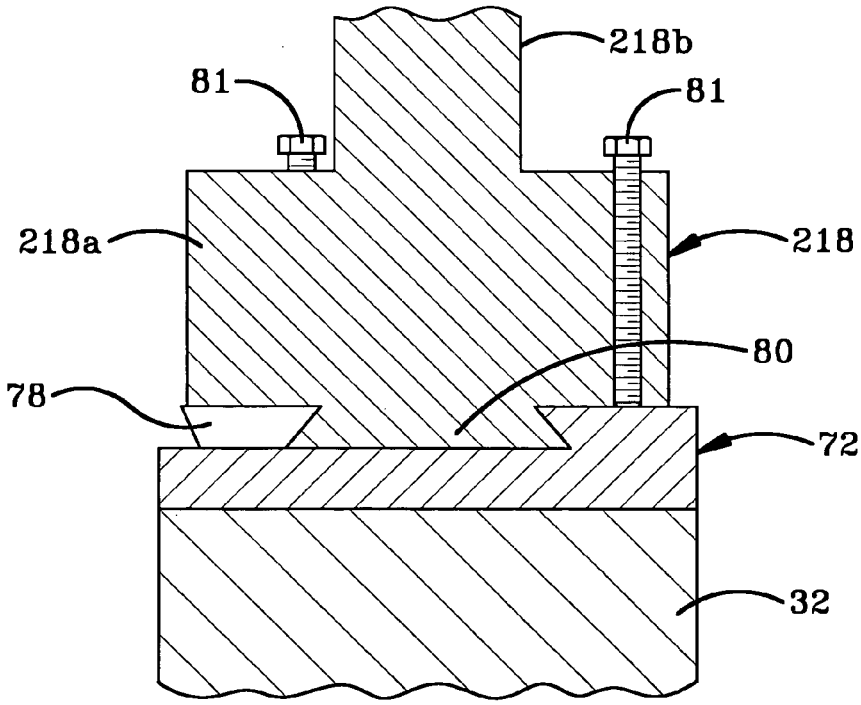
FIG. 8 is a partial cross-sectional side view through line 8—8 of FIG. 7, showing the starter stub engaged with the header.
Figure 9:
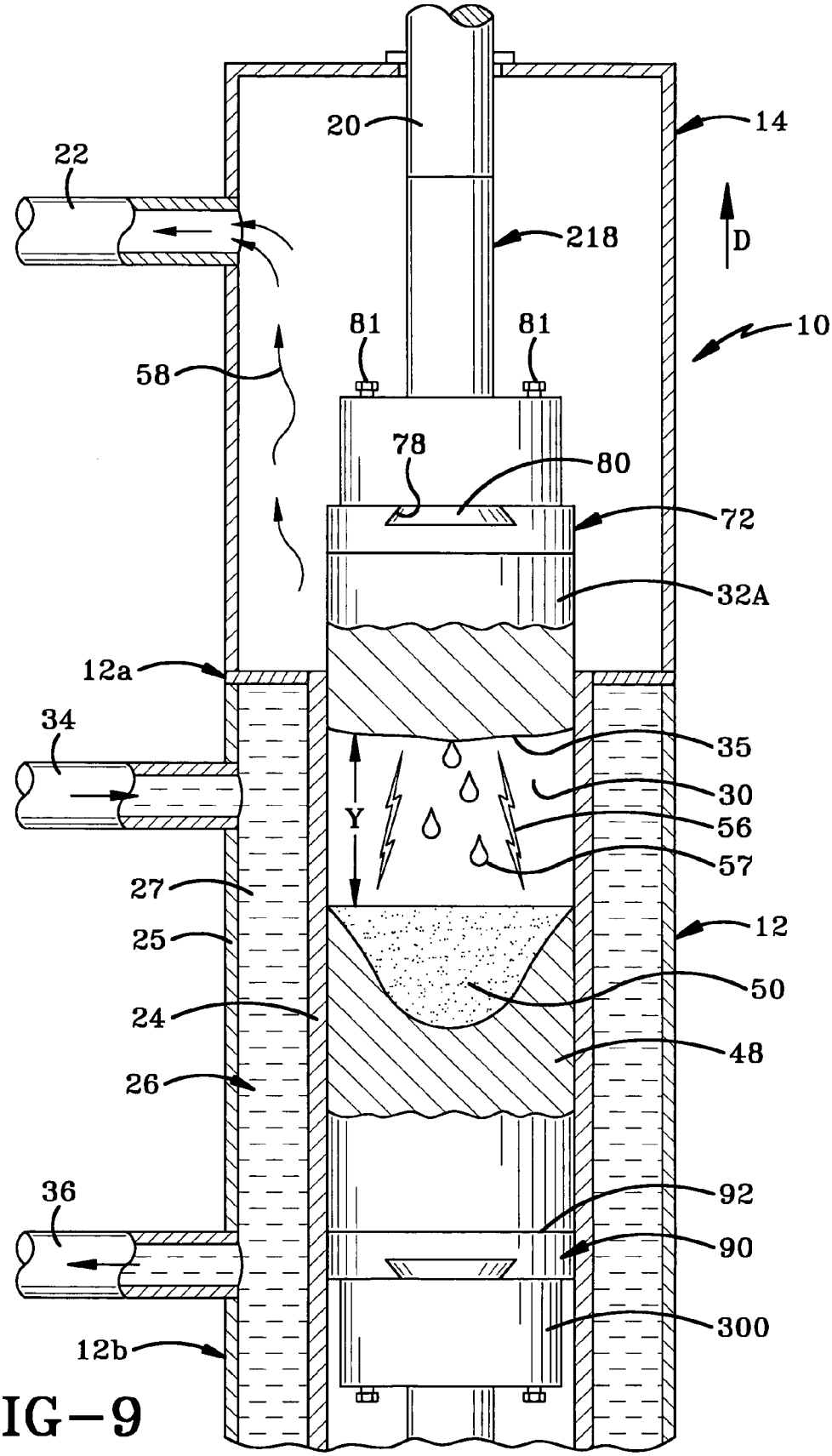
FIG. 9 is a partial cross-sectional front view of the furnace showing the second melt and the formation of a more refined ingot in the crucible.

Furnace 10 is used in the following manner. Starter stub 70 and electrode 16 are attached to header 18 as shown in FIG. 1. Header 18 with attached electrode 16 is lowered into crucible 12 to allow the metal from electrode 16 to be melted by direct current arc 56. Electrode 16 may be formed from scrap materials that are melted together in a plasma consolidation furnace by plasma arc melting or it may be formed by melting the scrap materials together with an electron beam. Alternatively, the scrap materials may be conventionally welded together. In the case of titanium or titanium alloys, electrode 16 may be formed by melting scrap pieces of metal such as titanium sponge compacts and bulk scrap pieces onto starter stub 70 in a plasma consolidation furnace (not shown). Starter stub 70 is placed into the plasma consolidation furnace and the scrap pieces are deposited into the furnace over starter stub 70 and the pieces are melted to a temperature just sufficient to bond them together and to starter stub 70. Alternatively, the scrap pieces may be bonded together as previously described and then the bonded mass may be conventionally welded directly onto starter stub 70. Starter stub 70 is then engaged with reusable header 18 by sliding the two components together so that dovetail-shaped projection 82 on header 18 engages the recess 84 on starter stub 70. Screws 86 are utilized to force the walls of projection 82 into abutting engagement with the walls of recess 84. Electrode 16 is lowered into the crucible by ram 20. A direct current arc 56 is struck between a first end 16*a* of electrode 16 and upper surface 74 of starter stub 72. Arc 56 heats electrode 16 to a temperature sufficient to melt the metal of electrode 16 and the molten metal 57 falls onto upper surface 74 of starter stub 72 and begins to accumulate. As the metal from electrode 16 falls onto starter stub 72, the upper surface 74 of starter stub 72 is partially melted by the hot molten metal. The molten metal is slowly cooled by water 27 circulating through compartment 26 and it begins to solidify and form an ingot 32. The ingot 32 becomes integrally attached to upper surface 74 as the metal solidifies. Molten metal continues to drip off first end 16*a* of electrode 16 onto the forming ingot 32. As the molten metal is hot, it partially remelts the upper surface of ingot 32, forming an ingot pool 38. The direct current arc 56 is then struck between first end 16*a* of electrode 16 and ingot pool 38. As electrode 16 melts and becomes smaller in size, ram 20 may be lowered in the direction of Arrow A (FIG. 1) to more or less maintain the gap X between the first end 16*a* of electrode 16 and ingot pool 38. Alternatively, ram 20 may be raised in the direction of arrow B to maintain the gap X between the first end 16*a* and ingot pool 38 as the ingot 32 increases in size. Alternatively, as the size of ingot 32 increases, starter stub 72 may be lowered out of crucible or hearth 12 in the direction of arrow C (FIG. 2) by second reusable header 218 to keep the relative distance X fairly constant. Electrode 16 is melted substantially completely so that all that remains is header 18 and starter stub 70. It will be understood by those skilled in the art that at least a part of starter stub 70 may be arced and melted into crucible 12. This tends to result in minimal contamination of ingot 32 because starter stub 70 is made from substantially the same material as is present in electrode 16. Eventually, ingot 32 solidifies completely and then starter stub 72 with attached ingot 32 may be withdrawn from crucible 12. The withdrawal may be accomplished by removing the starter stub 72 and ingot 32 through the upper end 12*a* of crucible 12 in the direction of Arrow A by way of a crane or through the lower end 12*b* of crucible 12 in the direction of Arrow C. The latter instance may be accomplished by the second reusable header 218 being connected to a second ram (not shown) and then being withdrawn in the direction of Arrow C (FIG. 2). Starter stub 72, with integrally attached ingot 32, may remain connected to second reusable header 218 for further processing. Second reusable header 218 with starter stub 72 and ingot 32 may be inverted and attached to ram 20 (as shown in FIG. 9) and then lowered into crucible 12. Ingot 32 is then utilized as an electrode 32A and can be remelted to produce a more refined ingot 48. Alternatively, header 218 with starter stub 72 and ingot 32 attached thereto may be shipped to another location for other industrial applications. Alternatively, starter stub 72 and integral ingot 32 may be detached from second reusable header 218 and then they may be attached to a different header for use in another crucible (not shown) or may be attached to reusable header 18. It will be understood by those skilled in the art that starter stub 70 may be reused by welding a second amount of scrap materials, titanium sponge compacts and bulk scrap pieces to it and then re-engaging starter stub 70 with header 18.

Figure 10:
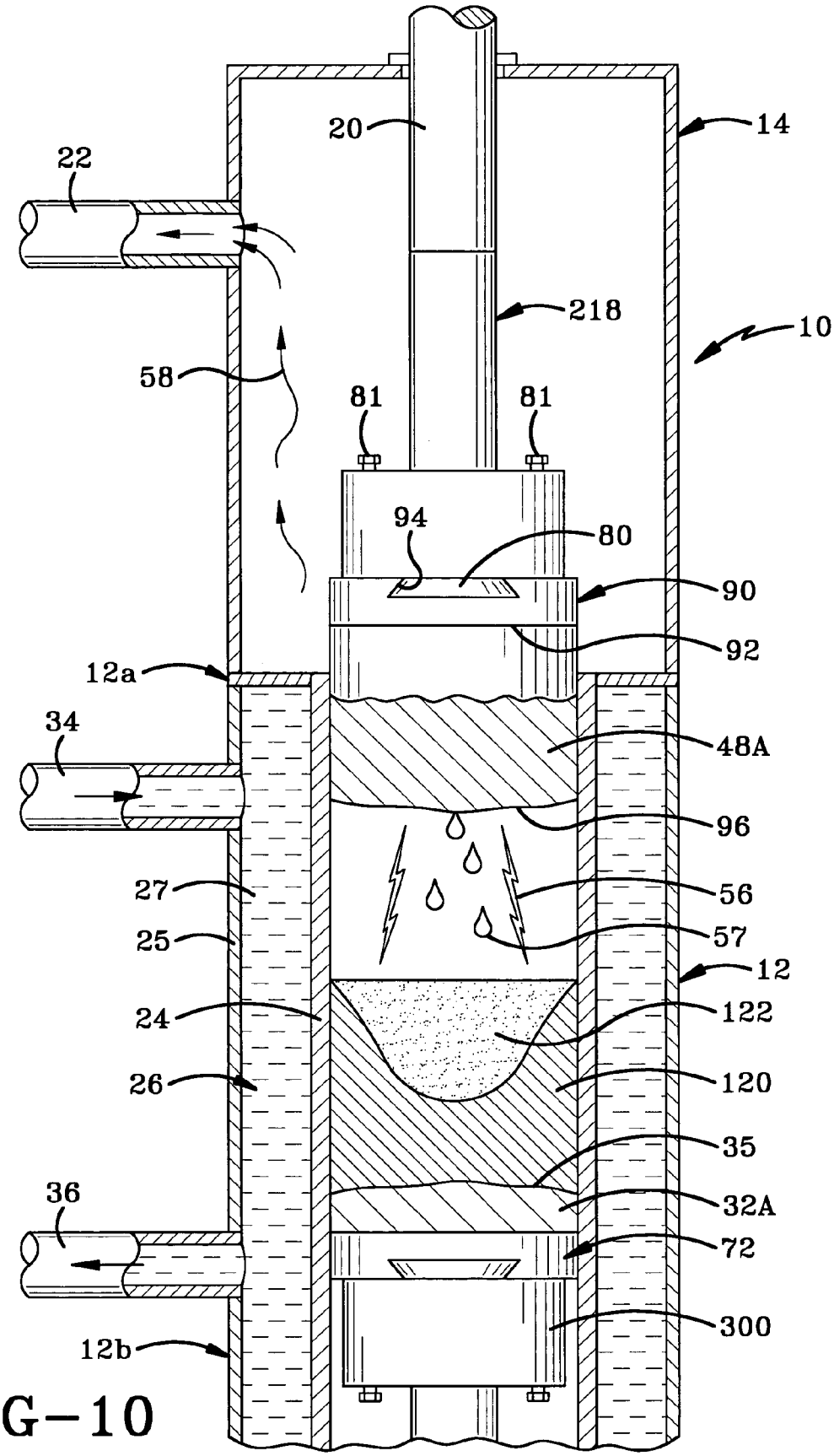
FIG. 10 is a partial cross-sectional front view of the furnace showing the final melt and showing the remnant of the previously melted electrode attached to a starter stub being remelted in the crucible.
Figure 11:
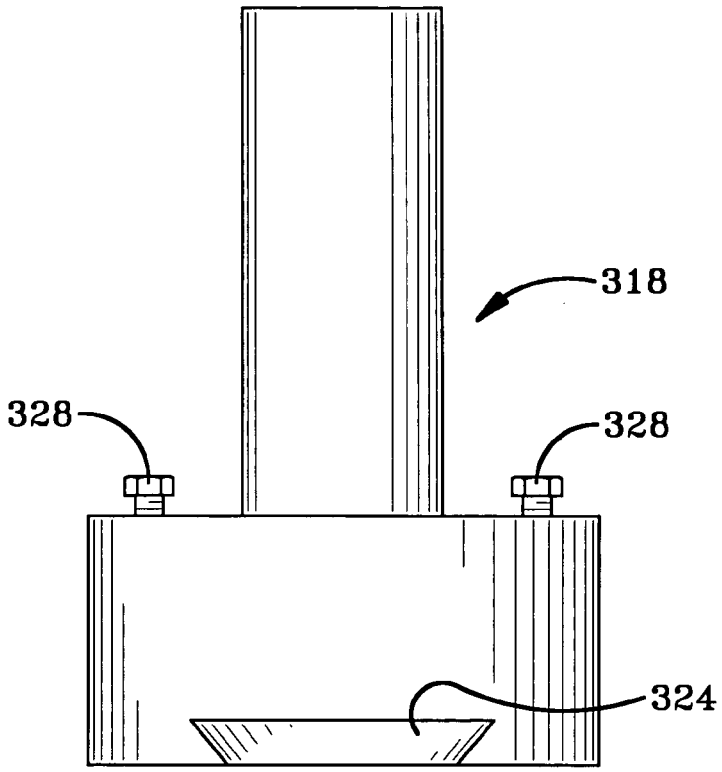
FIG. 11 is a front view of a second embodiment of the reusable header in accordance with the present invention.
Figure 12:
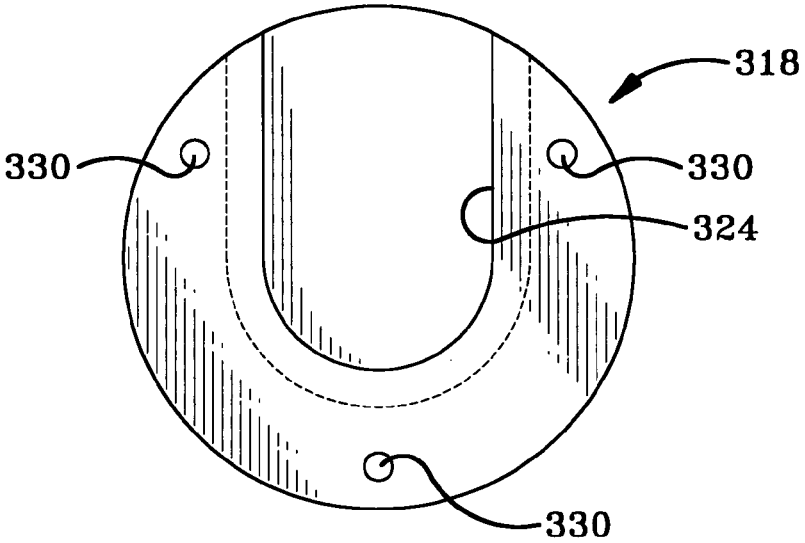
FIG. 12 is a bottom view of the reusable header of FIG. 11.
Figure 13:
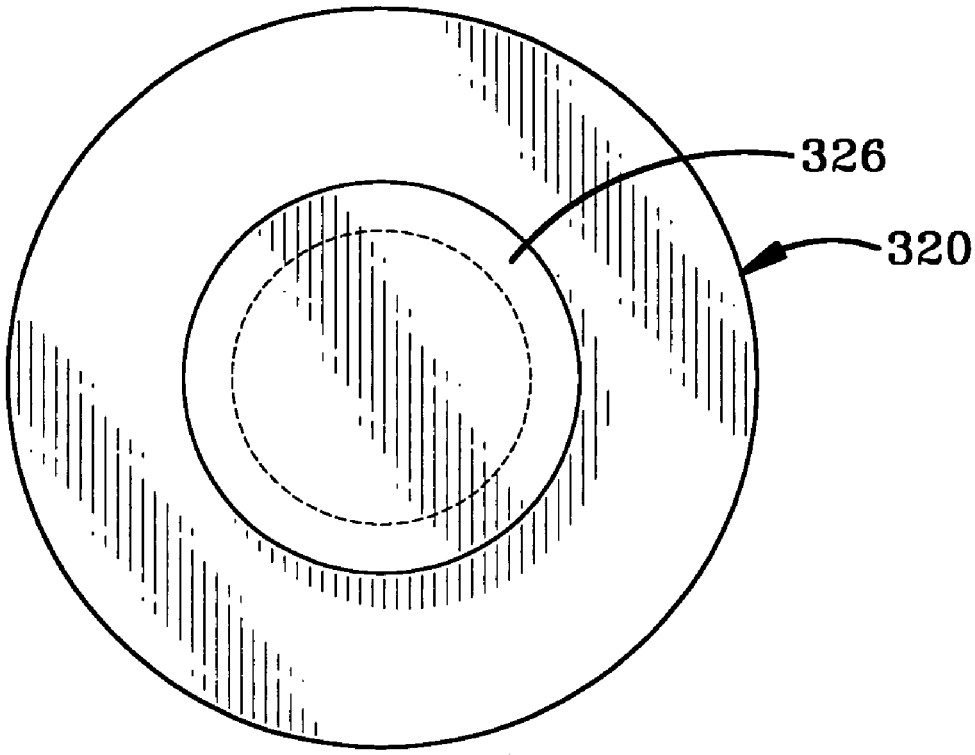
FIG. 13 is a top view of the starter stub for engagement with the reusable header of FIG. 11.
Figure 14:
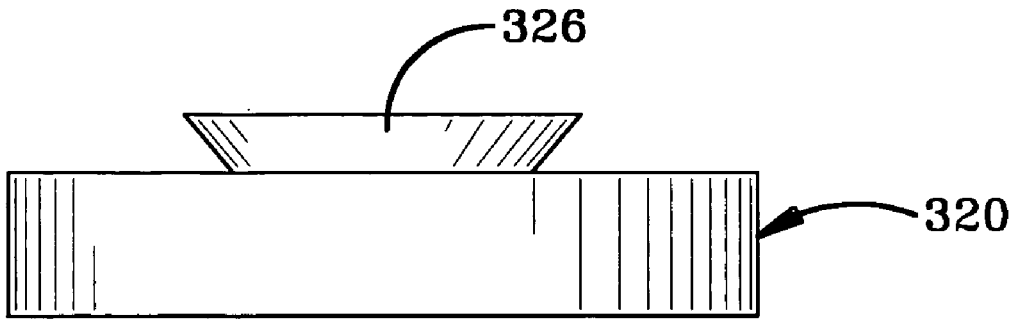
FIG. 14 is a front view of the starter stub.
Figure 15:
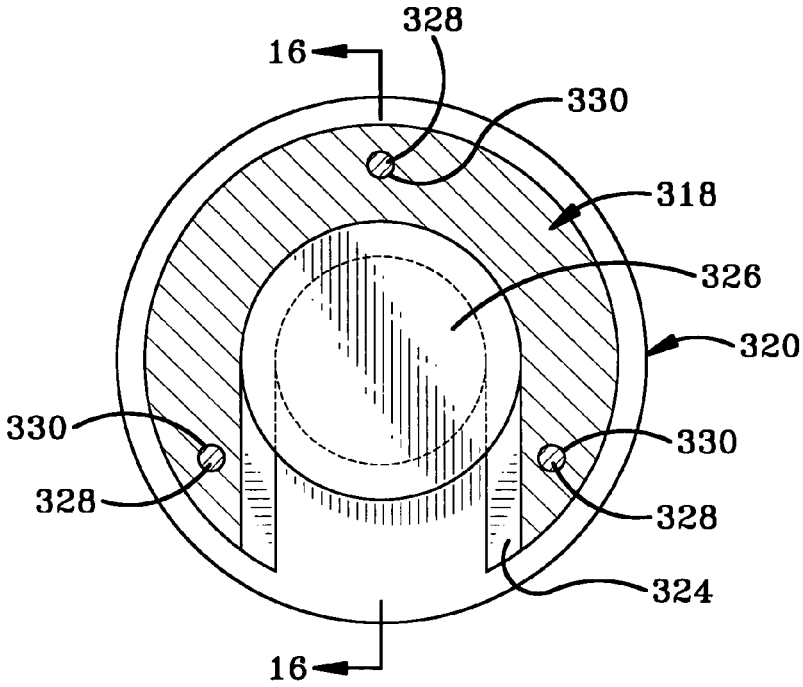
FIG. 15 is a partial cross-sectional bottom view showing the starter stub engaged with the header.
Figure 16:
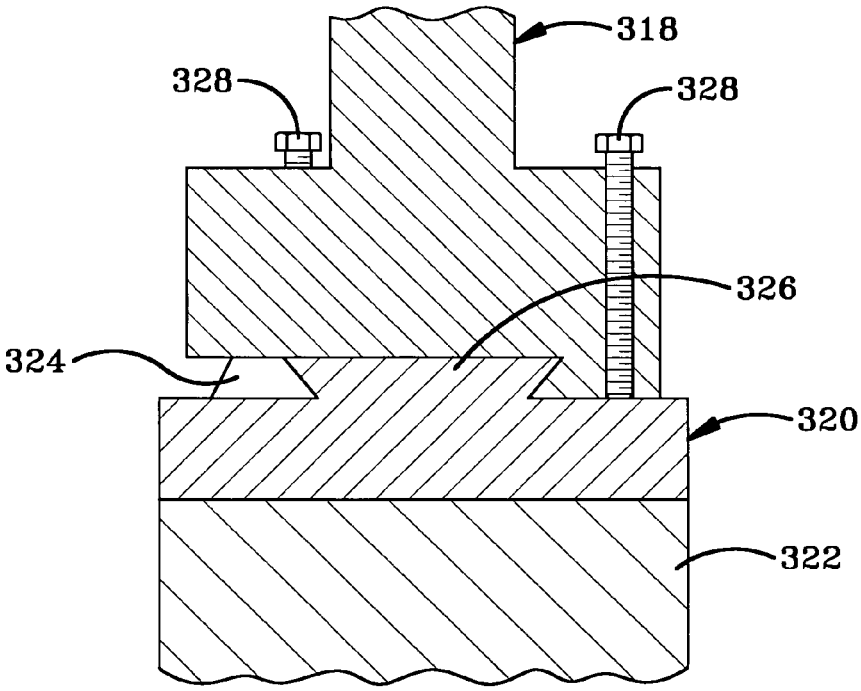
FIG. 16 is a partial cross-section side view through line 16—16 of FIG. 15 showing the starter stub engaged with the header.

In the next step and referring to FIGS. 9 and 10, starter stub 72 with electrode 32A is lowered by ram 20 into crucible 12. A direct current arc 56 is struck between electrode 32A and a third starter stub 90. Electrode 32A is heated to the until metal begins to melt off it and drop onto the upper surface 92 of starter stub 90. The molten metal drips onto upper surface 92 and as the molten metal it is hot it partially melts upper surface 92. The molten metal is cooled by water 27 circulating in compartment 26. Eventually a second ingot 48 begins to solidify and it becomes integrally bonded with upper surface 92 of third starter stub 90. As molten metal 57 continues to fall from electrode 32A, an ingot pool 50 is formed. Second electrode 32A may be melted down to the point that it is substantially consumed and only starter stub 72 remains connected to header 218. Accidental arcing of starter stub 72 or header 218 may occur at this stage, but because starter stub 72 and possibly header 218 are manufactured from substantially the same metal as electrode 32A, there will not be much contamination of ingot pool 50. As the size of second ingot 48 increases the size of the gap Y between lowermost end 35 and ingot pool 50 is maintained fairly constant by adjusting the position of ram 20 or starter stub 90 as described with reference to FIG. 1. Header 218 is then raised in the direction of arrow D, screws 81 are disengaged and starter stub 72 may then be removed from header 218 and be repositioned in crucible 12 for reuse.

Second ingot 48 solidifies in the manner previously described and may then be withdrawn from mold 30 either by lifting it out of the upper end 12*a* of crucible 12 by crane or lowering it out of lower end 12*b* by a second ram (not shown). Second ingot 48 is integrally bonded with third starter stub 90. Third starter stub 90 and ingot 48 may be shipped as a unit for other industrial applications, or they may be shipped with another reusable header 300 interlocked with third starter stub 90 or they may be connected to either reusable header 18 or reusable header 218. As previously described, if second ingot 48 is to be used as an electrode, it does not need to be allowed to cool before being repositioned in crucible 12 for remelting. As shown in FIG. 10, third reusable header 90 may be interlocked with reusable header 218 and then ingot 48 may be used as an electrode 48A to further refine the metal. In this instance, the projection 80 engages in recess 94 on third starter stub 90. Screws 81 are engaged to force the walls of projection 80 into engagement with the walls of recess 94.

Occasionally, starter stub 72 may include a remnant of ingot 32A. In this instance, starter stub 72 and the attached remnant of ingot 32A may be attached to a reusable header 300 and form the bottom wall of crucible. A direct current arc 56 is struck between the remnant of ingot 32A and the lowermost end 96 of electrode 48A. Electrode 48A melts and the molten material 57 drips down and is deposited onto the remnant of ingot 32A. The molten metal melts the surface 35 and part or all of the remnant of ingot 32A. The molten metal cools and a final ingot 120 begins to form within mold 30. Ingot 120 is integral with any metal remaining from the remnant of ingot 32A and ingot 120 is attached either directly or indirectly to starter stub 72. An ingot pool 122 forms as molten metal 57 continues to drip from ingot 48A. Eventually, the final ingot 120 solidifies and it and starter stub 72 may be removed from crucible 12 as previously described. The final ingot 120 is of higher metallurgical quality than electrode 48A, electrode 32A and electrode 16 because additional impurities have been removed during the remelting of the ingot 48A. Final ingot 120 may be utilized in other manufacturing processes as desired.

A second embodiment of the header 318 is shown in FIGS. 11 through 22. Referring to 11–16, it will be seen that header 318, a starter stub 320 and an electrode 322 may be attached to each other in a different manner. In this instance, header 318 is provided with a dovetail recess 324 and starter stub 320 is provided with a complimentarily shaped and configured dovetail projection 326. Electrode 322 is integrally bonded with starter stub 320 in the same manner as was described with reference to FIGS. 1 through 10. Screws 328 extend through apertures 330 to force the walls of projection 326 into abutting engagement with the walls of recess 324. In use, starter stub 320 is moved horizontally with respect to header 318 so that projection 326 slides into recess 324. Screws 328 are engaged to lock starter stub 320 and header 318 together. Header 318 may then be engaged with ram 20 and lowered into crucible 12 where a direct current arc is struck to melt electrode 322. When electrode 322 is essentially consumed, screws 328 are disengaged and starter stub 320 with a remnant of electrode 322 may be removed from header 318.

Referring to FIGS. 17 through 22, the second embodiment of reusable header 318 may also be used to engage a specially molded electrode as hereinafter described. Initially, header 318 is connected to a starter stub 420 onto which a first electrode 16 is bonded as described with reference to the first embodiment. Recess 324 of header 318 engages with a projection 424 that extends from starter stub 420. Screws 328 lock header 318 and starter stub 420 together. A form 100 is disposed proximate the lower end 12*b* of crucible 12 to effectively seal crucible 12 and thereby create a mold 30 for formation of ingots therein. Form 100 is supported proximate the lower end 12*b* by a third ram 102. Form 100 includes a shaped upper surface 104 and a substantially flat lower surface 106 that rests on third ram 102. Upper surface 104 includes a dovetail-shaped recess 108. Form 100 is manufactured from a metal that preferably melts at a higher temperature than the metal to be melted in furnace 10 such as that of electrode 16. Alternatively, form 100 may be manufactured from a composite material that does not melt when heated. A film 101 of a releasing agent may be applied to upper surface 104 and recess 108. A direct current arc 56 is struck between the lowermost end 16*a* of electrode 16 and upper surface 104 of form 100. As before, lowermost end 16*a* is heated to a temperature sufficient to melt the metal and drops of molten metal 57 fall onto upper surface 104. Recess 108 is filled and then molten metal overflows recess 108 and covers upper surface 104. As molten metal accumulates over form 100, the water 27 in compartment 26 causes the same to cool and an ingot 132 begins to form on form 100. Continued melting of electrode 16 causes the formation of an ingot pool 138. Once ingot 132 is completely solidified, ingot 132 is removed from crucible 12 either through upper end 12*a* by way of a crane or through lower end 12*b* by the lowering of ram 102 as previously described. At this stage ingot 132 is interlocked with form 100. The two components are moved horizontally with respect to each other and projection 110 on ingot 132 slides out of recess 108 on form 100. Ingot 132 is then available for attachment to a reusable header such as header 318 or it may be shipped to another location for further industrial processing. As was previously described, while projection 110 and recess 108 are indicated to be dovetail-shaped, it will be understood by those skilled in the art that any other suitably shaped recess and projection may be utilized without department from the spirit of the present invention. Starter stub 420 may be removed from header 318 and ingot 132 may be attached to header 318. This is achieved by moving the two components horizontally relative to each other so that projection 110 on ingot 132 slides into recess 324 on header 318. Screws 328 are engaged to lock the walls of projection 110 in abutting relationship with the walls of recess 324. Ingot 132 may then be used as an electrode 132A (FIG. 21) and may be lowered by ram 20 into crucible 12 for remelting. Form 100 may be reinserted into the lower end 12*b* of crucible 12 and a releasing agent film 101 applied thereto. A direct current arc 56 is struck between upper surface 104 of form 100 and lower surface 135 of electrode 132A. A new ingot 148 and ingot pool 150 are formed in the manner previously described. Once ingot 148 is solidified, form 100 is removed from crucible 12 as previously described. Ingot 148 is released from form 100 and may then be engaged with header 318 by interlocking projection 210 on ingot 148 with recess 324 on header 318. Ingot 148 may then be used as an electrode 148A. Form 100 with releasing film 101 may then be reinserted into crucible 12 and a direct current arc 56 is struck between the lower surface 150 of electrode 148A and upper surface 104 of form 100. A final ingot 190 is produced as previously described. Final ingot 190 is of improved metallurgical quality with respect to electrodes 148A, 132A and 16. It will be understood in the art that a plurality of differently shaped forms 100 may be utilized so that they may be attached to differently configured headers to allow the manufacturer to identify different metallurgical quality electrodes.

It will be understood by those skilled in the art that a manufacturer may use a combination of different starter stubs 72, forms 100 and headers to producing differently shaped and configured electrodes. These different configurations will depend on the end use of the electrodes by the manufacturer and any customers of the manufacturer. For example, the same header may be utilized for attachment of a plurality of electrodes or, alternatively, a series of identical headers may be utilized throughout the remelting process or alternatively a series of different headers and complimentarily shaped electrodes or starter stubs may be utilized throughout the remelting process. It will be understood by those skilled in the art that it is possible to put together a series of reusable headers and/or bottom plates with molds to allow for a series of differently shaped ingots/electrodes to be created by the above-described process. Whatever the combination desired by the user, it will be understood by those skilled in the art that the reusable headers are made of a metal that is of similar metallurgical quality to the electrode to be melted.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A method of manufacturing electrodes, the method comprising the steps of:

a) attaching a first electrode to a first reusable header; wherein said reusable header includes a shaped first end;

b) heating the first electrode to a temperature sufficient to melt said first electrode;

c) depositing the molten metal from the first electrode into a crucible;

d) solidifying the molten metal to form a second electrode, where said second electrode has at least a portion molded to be complementary shaped to the first end of the first reusable header;

e) inverting the second electrode;

f) interlocking the shaped portion of the second electrode with the first end of the first reusable header; and g) melting the second electrode to form an ingot of increased purity.

2. A method of manufacturing electrodes, the method comprising the steps of:

a) attaching a first electrode to a first reusable header;

b) heating the first electrode to a temperature sufficient to melt said first electrode;

c) depositing the molten metal from the first electrode into a crucible;

d) solidifying the molten metal to form a second electrode, whereby said second electrode has at least a portion complementary shaped to a second reusable header;

e) attaching the second electrode to the second reusable header;

f) positioning the second electrode attached to the second reusable header in communication with a second crucible, the second crucible having at least a portion complementary shaped to a third reusable header;

g) heating the second electrode to a temperature sufficient to melt said second electrode;

h) depositing molten metal from the second electrode into said second crucible;

i) solidifying the molten metal from the second electrode to form a third electrode.

3. The method of manufacturing as set forth in claim 2, further comprising the steps of:

attaching the third electrode to the third reusable header and repeating the steps of positioning a remelted electrode in communication with a crucible, heating the remelted electrode to a temperature sufficient to melt the same; depositing the molten metal into the crucible and solidifying the molten metal to form an additional electrode, until a final electrode of the desired metallurgical quality is produced.

4. The method of manufacturing as set forth in claim 2, wherein the first and second reusable headers are of similar physical configuration.

5. The method of manufacturing as set forth in claim 3, wherein at least two of the first, second and third reusable headers are of similar physical configuration.

6. The method of manufacturing as set forth in claim 5, wherein all of the first, second and third reusable headers are of similar physical configuration.

7. The method of manufacturing as set forth in claim 1, further comprising a step of:

placing a stub in the crucible prior to the step of heating the first electrode; the stub being positioned so that it forms the bottom surface of the crucible; and wherein the stub has an upper surface and a lower surface, the lower surface being complementary shaped to the shaped end of the second reusable header and including the one of a shaped projection and shaped recess; and wherein the stub is placed in the crucible so that the one of the shaped projection and recess faces downwardly away from the first electrode.

8. The method of manufacturing as set forth in claim 7, further comprising the steps of:

dripping the molten metal from the heated first electrode onto the upper surface of the stub;

melting at least a portion of the upper surface of the stub; and integrally bonding the second electrode to the upper surface of the stub.

9. The method of manufacturing as set forth in claim 1, wherein the step of attaching the first electrode to the first reusable header is accomplished by slidingly interlocking a complementary shaped projection of one of the first electrode and first reusable header together with a recess of the other of the first electrode and first reusable header; and then clamping the first electrode and first reusable header together.

10. The method of manufacturing as set forth in claim 9, wherein the step of clamping the first electrode to the first reusable header includes the step of threading fasteners against the shaped projection of the one of the first electrode and the first reusable header so that relative movement between the first electrode and first reusable header is substantially prevented.

11. The method of manufacturing as set forth in claim 9, wherein the step of attaching the first electrode to the first reusable header includes the step of:

integrally bonding the first electrode to a stub, wherein the stub has a lower surface that includes one of a projection and recess complementary shaped to the one of the projection and recess formed in the first reusable header and subsequently interlocking the stub and the first reusable header together.

12. The method of manufacturing as set forth in claim 11, wherein the stub is manufactured from the same material as the first electrode.

13. The method of manufacturing as set forth in claim 11, further comprising the step of placing scrap metal pieces into a cold hearth furnace and then heating the pieces to a temperature sufficient to at least partially bond them together to form the first electrode.

14. The method of manufacturing as set forth in claim 13, further comprises the step of welding the bonded scrap metal pieces to the stub.

15. The method of manufacturing as set forth in claim 2, wherein the step of attaching the second electrode to the second reusable header is accomplished by interlocking complementary shaped portions of the second electrode and second reusable header together.

16. The method of manufacturing as set forth in claim 15, wherein the step of attaching the second electrode to the second reusable header includes the step of integrally bonding the second electrode to a second stub, wherein the second stub has a lower surface that includes one of a projection and a recess complementary shaped to one of a projection and a recess formed in the second reusable header and subsequently interlocking the complementary shaped projection and recess of the second stub and the second reusable header together.

17. The method of manufacturing as set forth in claim 16, wherein the step of attaching the second electrode to the second reusable header further includes the step of threading fasteners against one of the shaped area and the shaped portion of the second stub and the second reusable header, so that relative movement between the second stub and second reusable header is substantially prevented.

18. A method of manufacturing ingots, the method comprising the steps of:

a) providing a first electrode with one of a projection and a recess formed in an upper end thereof;

b) providing a first reusable header with the other of a projection and a recess formed in a lower end thereof: wherein at least a section of the first reusable header is manufactured from substantially the same metal as the first electrode;

c) engaging the upper end of the first electrode with the lower end of the first reusable header;

d) clamping the first electrode and first reusable header together;

e) heating a lower end of the first electrode to a temperature sufficient to progressively melt said first electrode;

f) depositing the molten metal from the first electrode into a crucible;

g) solidifying the molten metal to form an ingot.

19. A method of manufacturing electrodes comprising the steps of:

a) attaching a first electrode to a first reusable header, wherein at least a section of the first reusable header is manufactured from substantially the same metal as the first electrode;

b) heating the first electrode to a temperature sufficient to melt said first electrode;

c) depositing the molten metal from the first electrode into a crucible;

d) solidifying the molten metal to form a second electrode;

e) attaching the second electrode to the second reusable header, wherein at least a section of the second reusable header is manufactured from substantially the same metal as the second electrode;

f) positioning the attached second electrode and second reusable header in communication with a second crucible;

g) heating the second electrode to a temperature sufficient to melt said second electrode;

h) depositing molten metal from the second electrode into said second crucible;

i) solidifying the molten metal from the second electrode to form a third electrode.

20. The method of manufacturing as set forth in claim 19, further comprising the steps of:

attaching the third electrode to a third reusable header, wherein at least a section of the third reusable header is manufactured from substantially the same metal as the third electrode; and subsequently repeating the steps of positioning a remelted electrode in communication with a crucible, heating the remelted electrode to a temperature sufficient to melt the same; depositing the molten metal into the crucible and solidifying the molten metal to form an additional electrode, until a final electrode of the desired metallurgical quality is produced.

21. The method of manufacturing as set forth in claim 19, wherein the step of attaching the first electrode to the first header further comprises the step of:

interlocking complimentary shaped portions on the first electrode and first reusable header together.

22. The method of manufacturing as set forth in claim 20, wherein said section of the first reusable header is a detachable stub and said step of attaching the first electrode to the first reusable header further comprises the step of:

integrally bonding the first electrode to the stub.

23. The method of manufacturing as set forth in claim 22, further comprising the step of placing scrap metal pieces into a cold hearth furnace and then heating the pieces to a temperature sufficient to at least partially bond them together to form the first electrode.

24. The method of manufacturing as set forth in claim 23, further comprises the step of welding the bonded scrap metal pieces to the stub.

25. The method of manufacturing as set forth in claim 22, wherein the step of attaching the first electrode to the first reusable header is accomplished by interlocking complementary shaped portions of the stub and first reusable header together.

26. The method of manufacturing as set forth in claim 25, wherein the first and second reusable headers are of similar physical configuration.

27. The method of manufacturing as set forth in claim 26, wherein at least two of the first, second and third reusable headers are of similar physical configuration.

28. The method of manufacturing as set forth in claim 27, wherein all of the first, second and third reusable headers are of similar physical configuration.

29. The method of manufacturing as set forth in claim 19; wherein said section of the second reusable header is a detachable second stub and said step of attaching the second electrode to the second reusable header further comprises the steps of:

placing the second stub in the crucible prior to step of heating the first electrode;

dripping the molten metal from the heated first electrode onto the upper surface of the second stub;

melting at least a portion of the upper surface of the second stub; and integrally bonding the second electrode to the upper surface of the second stub.

30. The method of manufacturing as set forth in claim 29, wherein the step of attaching the second electrode to the second reusable header is accomplished by interlocking complementary shaped portions of the second stub and second reusable header together.

31. The method of manufacturing as set forth in claim 30, wherein the step of attaching the second electrode to the second reusable header further includes the step of threading fasteners against the shaped portion of one of the second stub and the second reusable header so that relative movement between the second stub and second reusable header is substantially prevented.

32. The method of manufacturing electrodes as defined in claim 1, wherein the method further includes the step of attaching the first reusable header to a vertically movable ram.

33. The method of manufacturing ingots as defined in claim 18, wherein the projection and recess are dovetail in shape and the projection formed on one of the first electrode and reusable header is slidingly engaged into the recess formed in the other of the first electrode and reusable header.

34. The method of manufacturing ingots as defined in claim 33, further including the step of screwing a plurality of screws outwardly from the first end of the first reusable header to urge an upper end of the second electrode away from the first end of the first reusable header and to thereby prevent said projection from sliding out of said recess.

35. A reusable header for supporting an electrode for melting in a furnace, the reusable header comprising:

a base having a first end and a second end;

a shaft extending from the first end of the base, the shaft being adapted to connect the header to a ram for reciprocal movement within the furnace;

an attachment adapted to releasably secure the electrode to the second end of the base; wherein the attachment comprises a shaped recess and a shaped projection being complementary shaped to interlock with each other, wherein one of the shaped recess and projection is formed in the second end of the base and the other of the shaped recess and projection is formed on the electrode; and wherein the recess has first walls and the projection has second walls and the header further includes at least one clamp that forces the second walls of the projection into engagement with the first walls of the recess.

36. The reusable header as set forth in claim 35, wherein the clamp is at least one screw.

37. The reusable header as set forth in claim 36, wherein the screw enters the first end of the base, extends through the base and terminates adjacent the shaped end of the electrode at the second end of the base.

38. The reusable header as set forth in claim 35, wherein at least a section of the header is manufactured from a metal that is substantially the same as the electrode which it is adapted to support.

39. The reusable header as set forth in claim 38, wherein said section is a detachable stub, said stub having an upper surface and a lower surface; the stub being releasably connectable to the header.

40. The reusable header as set forth in claim 39, wherein the lower surface of the stub has includes one of a projection and a recess complementary shaped to one of the projection and recess formed in the header and the shaped area one of the projection and recess of the stub interlocks with the shaped one of the projection and recess of the header.

41. The reusable header as set forth in claim 40, wherein the electrode is integrally bonded with the upper surface of the stub.

42. The reusable header as set forth in claim 41, wherein the complementary recess and projection formed in the stub and header are of a dovetail shape.

43. The reusable header as set forth in claim 42, wherein the recess has first walls and the projection has second walls and the header further includes at least one clamp that forces the second walls of the projection into engagement with the first walls of the recess.

44. The reusable header as set forth in claim 43, wherein the clamp is at least one screw.

45. The method of manufacturing electrodes as defined in claim 1, wherein the first end of the first reusable header includes one of a projection and a recess and the shaped portion of the second electrode includes the other of a projection and a recess; and wherein the method further includes the step of sliding the second electrode laterally relative to the first reusable header to engage the projection in the recess.

46. The method of manufacturing electrodes as defined in claim 1, wherein the first reusable header further includes a clamping mechanism; and wherein the method of manufacture further includes the step of engaging the clamping mechanism to lock the second electrode to the first reusable header.

47. The method of manufacturing electrodes as defined in claim 46, wherein the first end of the first reusable header includes the recess therein and the shaped portion of the second electrode includes the projection; and the method of manufacturing includes the step of screwing a plurality of screws into the recess to engage the projection and thereby lock the second electrode to the first reusable header.

* * * * *

UNITED STATES PATENT AND TRADEMARK OFFICE

CERTIFICATE OF CORRECTION

PATENT NO. : 6,983,007 B2
DATED : January 3, 2006
INVENTOR(S) : Bartlo, Louis J. Jr. et al.

It is certified that error appears in the above-identified patent and that said Letters Patent is hereby corrected as shown below:

Title page,
Item [75], Inventors, change "Barto" to -- Bartlo --.

Signed and Sealed this

Eleventh Day of April, 2006

JON W. DUDAS
*Director of the United States Patent and Trademark Office*